US009793688B2

(12) United States Patent
Friery et al.

(10) Patent No.: US 9,793,688 B2
(45) Date of Patent: Oct. 17, 2017

(54) SPARKPLUG HAVING VARIABLE SPARK GAP AND IGNITION DEVICE FOR THE SAME

(71) Applicant: DENSO International America, Inc., Southfield, MI (US)

(72) Inventors: Blaise Friery, Farmington Hills, MI (US); Nicholas Polcyn, Commerce, MI (US); Nicholas Lee, Clarkston, MI (US)

(73) Assignee: DENSO International America, Inc., Southfield, MI (US)

( * ) Notice: Subject to any disclaimer, the term of this patent is extended or adjusted under 35 U.S.C. 154(b) by 160 days.

(21) Appl. No.: 14/944,290

(22) Filed: Nov. 18, 2015

(65) Prior Publication Data

US 2017/0141544 A1 May 18, 2017

(51) Int. Cl.
*H01T 13/26* (2006.01)
*H01T 15/00* (2006.01)

(52) U.S. Cl.
CPC ..... *H01T 13/26* (2013.01); *H01T 15/00* (2013.01)

(58) Field of Classification Search
CPC ..... H01T 13/26; H01T 15/00
See application file for complete search history.

(56) References Cited

U.S. PATENT DOCUMENTS

2003/0089325 A1 5/2003 Marforio et al.

*Primary Examiner* — Joseph L Williams

(57) ABSTRACT

A center electrode is electrically coupled with a main terminal. A ground electrode is opposed to the center electrode to form a gap therebetween. A piezo actuator changes in length on application of a voltage. The piezo actuator actuates one of the center electrode and the ground electrode to manipulate the gap.

14 Claims, 11 Drawing Sheets

SPARKPLUG HAVING VARIABLE SPARK GAP AND IGNITION DEVICE FOR THE SAME

TECHNICAL FIELD

The present disclosure relates to a sparkplug having a variable spark gap. The present disclosure further relates to an ignition device for the sparkplug.

BACKGROUND

Conventionally, a sparkplug is employed in an internal combustion engine. A sparkplug may be desirable to have a configuration to enhance both spark generation and ignition of air-fuel mixture.

SUMMARY

According to an aspect of the preset disclosure, a center electrode may be electrically coupled with a main terminal. A ground electrode may be opposed to the center electrode to form a gap therebetween. A piezo actuator may change in length on application of a voltage. The piezo actuator may actuate one of the center electrode and the ground electrode to manipulate the gap.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

As follows, a first embodiment of the present disclosure will be described with reference to drawings. In the description, a vertical direction may be along an arrow represented by "LONGITUDINAL" in drawing(s). A lateral direction may be along an arrow represented by "RADIAL" in drawing(s).

Figure 1:
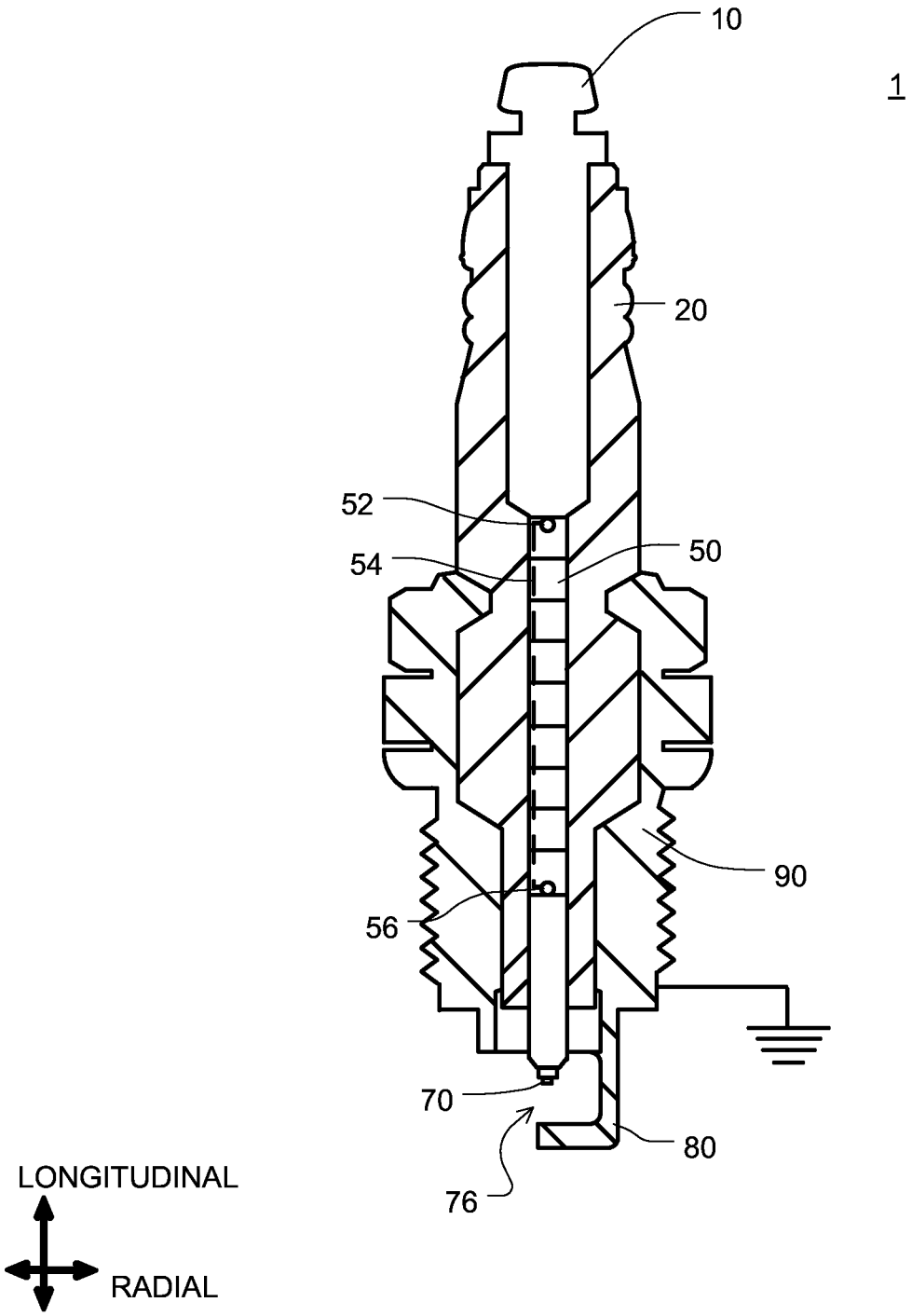
FIG. 1 is a schematic sectional view showing a sparkplug of a first embodiment.

In FIG. 1, a sparkplug 1 may be equipped to a combustion chamber (not shown) of an internal combustion engine. The sparkplug 1 may be configured to produce a spark for igniting mixture gas in the combustion chamber. The sparkplug 1 may include a main terminal 10, an insulator 20, a piezo actuator 50, a center electrode 70, and a housing 90. A ground electrode 80 may be a part of the housing 90. The center electrode 70 and the ground electrode 80 may be opposed to form a gap 76 therebetween. The main terminal 10 may be formed of a conductive metallic material such as copper alloy. The electrodes 70 and 80 may be formed of a metallic material, such as iridium alloy, platinum, and/or molybdenum. The housing 90 may be formed of a conductive material such as stainless steel. The insulator 20 may be formed of an insulative material such as ceramic.

The piezo actuator 50 may be formed of a piezo electric material, such as a piezo ceramic, for example, lead zirconate titanate (PZT) or barium titanate. The piezo actuator 50 may be a piezo stack having a layered structure including multiple piezo ceramic layers. The piezo actuator 50 may be configured to change in length on application of a voltage.

The piezo actuator 50 may be connected with the main terminal 10 at one end and may be connected with the center electrode 70 at the other end. The piezo actuator 50 and the center electrode 70 may be surrounded by the insulator 20 and may be configured to actuate the center electrode 70 axially back and forth relative to the insulator 20 in the longitudinal direction. The housing 90 surrounds the insulator 20, the piezo actuator 50, and the center electrode 70. The housing 90 may have a screw thread, which enable the sparkplug 1 to be screwed into a cylinder head of the engine. The housing 90 may be grounded via the cylinder head.

The piezo actuator 50 may have internal terminals 52 and 56. The internal terminals 52 and 56 may be located at both ends of the piezo actuator 50 and may be electrically coupled with its internal piezo electric layers. The internal piezo electric layers may be applied with a voltage through the internal terminals 52 and 56 thereby being operated. The piezo actuator 50 may be electrically coupled with the main terminal 10 at one end through one internal terminal 52. The piezo actuator 50 may be further electrically coupled with the center electrode 70 at the other end through the other internal terminal 56. Thus, when voltage relative to the ground is applied to the main terminal 10, the voltage may be applied on the piezo actuator 50 through the internal terminals 52 and 56.

The piezo actuator 50 may have a specific property. Specifically, in the present example, the piezo actuator 50 may be configured to shrink in the longitudinal direction, on application of voltage. The piezo actuator 50 may be further configured to expand in the longitudinal direction to its original form, on release of the application of voltage.

The property of the piezo actuator 50 may be given by polarizing the piezoelectric elements in advance. For example, piezoelectric elements may be applied with a predetermined high-voltage at a predetermined temperature to cause polarization. The predetermined temperature may be higher than a Curie temperature of the piezoelectric elements. Thus, the polarized piezoelectric elements may have a positive side and a negative side. When positive voltage is applied to the positive side of the piezo stack, the positive side may move away thereby to shrink. When positive voltage is applied to the negative side of the piezo stack, the negative side may be attracted thereby to expand.

The piezoelectric elements may be layered to form a piezo stack. The piezo stack may be accommodated in a cylindrical metallic case. The cylindrical metallic case may have the internal terminals 54 and 56.

In the example, the piezo actuator 50 may include an internal conductor 54, which electrically couples the internal terminals 52 and 56 to enable conduction of electric current between the internal terminals 52 and 56. Thus, the internal conductor 54 may enable conduction of electric current between the main terminal 10 and the center electrode 70. When voltage relative to the ground is applied to the main terminal 10, the voltage may be also applied on the piezo actuator 50. The internal conductor 54 may be formed of a conductive material such as a copper material and may be formed along an inner periphery of the cylindrical metallic case.

In addition, the center electrode 70, the internal terminal 56, the internal conductor 54, the internal terminal 52, and the main terminal 10 may form a circuit to conduct electric current therethrough. The internal conductor 54 may conduct a limited quantity of electric current not to exert a large effect on, i.e, not to drastically interrupt application of voltage on the piezo actuator 50. The limited quantity of electric current may be a quantity required to cause a spark in the gap 76. The internal conductor 54 may maintain electric conductivity between the main terminal 10 and the center electrode 70 even when the piezo actuator 50 axially expands and even when the center electrode 70 axially moves.

Figure 2:
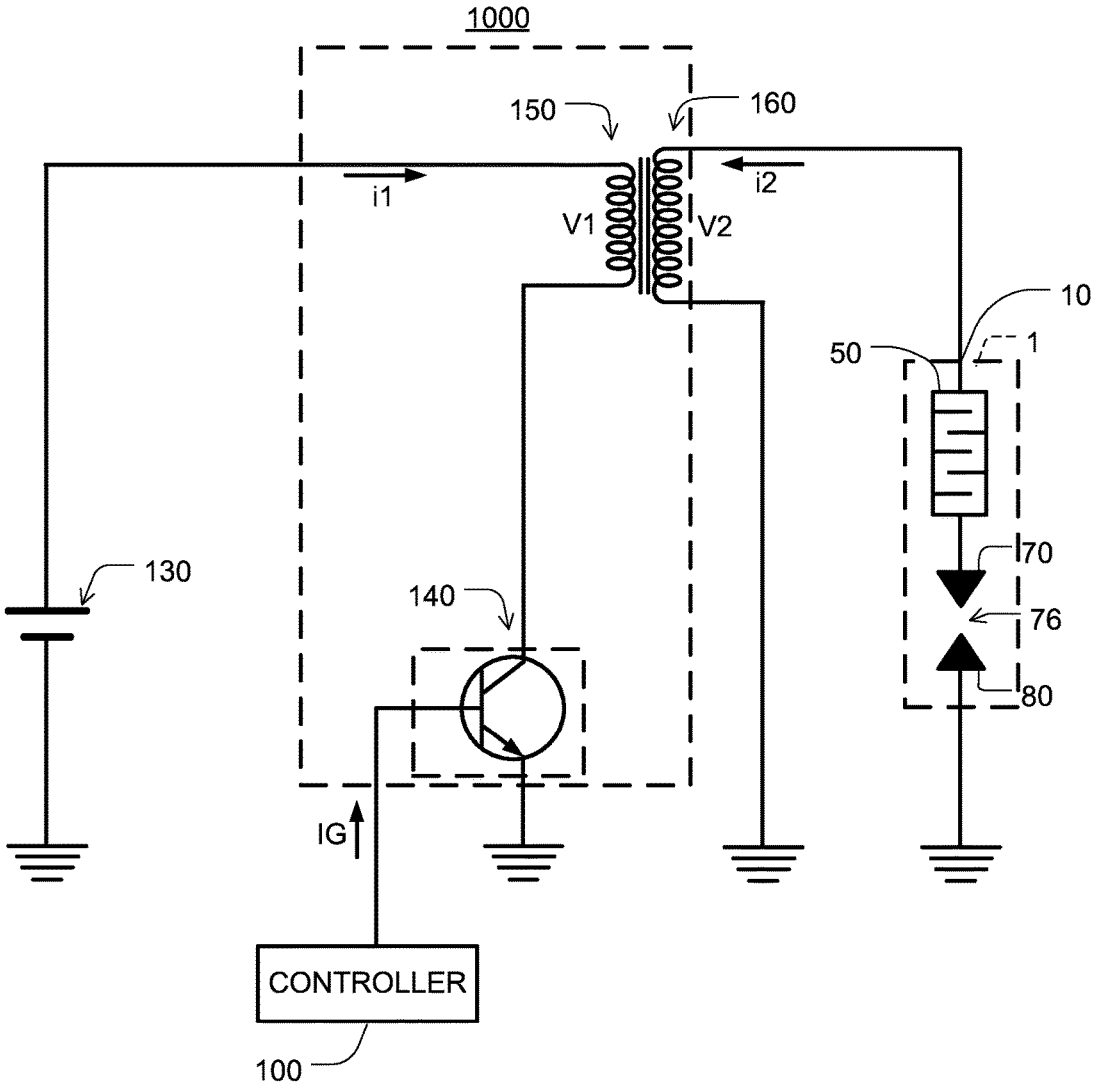
FIG. 2 is a schematic diagram showing an ignition device for the sparkplug.

As shown in FIG. 2, an ignition device 1000 includes a primary coil 150, a secondary coil 160, and an igniter switch 140. The primary coil 150 is, for example, a copper wire wound around a cylindrical center core formed of a soft magnetic material. The primary coil 150 may be electrically coupled with a power source 130 external from the ignition device 1000. The primary coil 150 may be configured to conduct electric power supplied from the power source 130. The secondary coil 160 is, for example, a copper wire wound around a cylindrical resin bobbin. The secondary coil 160, the bobbin, the primary coil 150, and the center core may be concentric with each other and may be magnetically coupled together thereby to form a magnetic circuit. The number of turns of the secondary coil 160 may be greater than that of the primary coil 150 to boost a primary voltage V1 into a secondary voltage V2.

The igniter switch 140 may be connected with a control unit 100. The igniter switch 140 may receive an ignition signal IG from the control unit 100 and may control electric power supplied from the power source 130 to the primary coil 150.

The igniter switch 140 may be an insulated gate bipolar transistor (IGBT) molded with an insulative resin material. An igniter switch 40 may have an emitter connected with an external ground through a wiring and may be grounded. The igniter switch 40 may have a base connected with the control unit 100 to receive the ignition signal IG. The igniter switch 40 may have a collector connected with the power source 130 through wirings and the primary coil 150. On receiving the ignition signal IG from the control unit 100 through the base, the igniter switch 140 may conduct electric current between the collector and the emitter. In this way, igniter switch 140 may cause the power source 130 to supply a primary current i1 at a primary voltage V1 into the primary coil 150. The ignition device 1000 may boost the primary voltage V1 applied to the primary coil 150 into the secondary voltage V2 applied to the secondary coil 160. The ignition device 1000 may be configured to apply a part of the secondary voltage V2 between the center electrode 70 and the ground electrode 80 of the sparkplug 1 thereby to break electrical insulation at the gap 76. Thus, the center electrode 70 and the ground electrode 80 may cause electric current therebetween thereby to produce a spark discharge at the gap 76. Meanwhile, the ignition device 1000 may be further configured to apply a part of the secondary voltage V2 to the piezo actuator 50.

Figure 3:
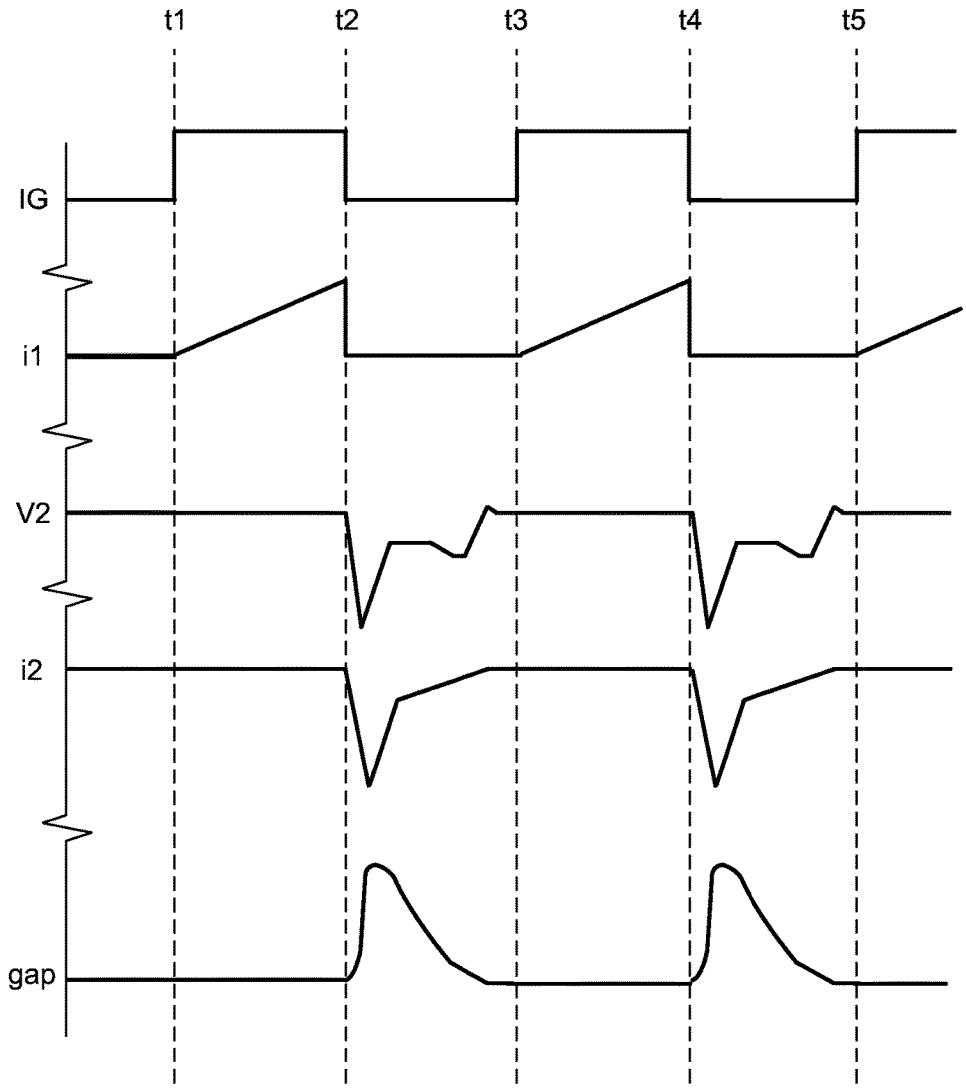
FIG. 3 is a time chart showing an operation of the ignition device.

Subsequently, operation of the ignition device 1000 and the sparkplug 1 will be described with reference to FIG. 3. When the control unit 100 activates (turn ON) the ignition signal IG at a timing t1, the primary current i1 from the power source 130 may start increasing to flow through the primary coil 150.

When the primary current i1 reaches a sufficient current value at a timing t2, the igniter switch 40 may deactivate (turn OFF) the ignition signal IG. In this way, the igniter switch 40 may terminate the supply of the primary current i1 from the power source 130 to the primary coil 150. Thus, a magnetic energy accumulated in the magnetic circuit of the ignition device 1000 may be induced into the secondary coil 160 thereby to boost the primary voltage V1 to the secondary voltage V2. The secondary coil 160 may apply the boosted secondary voltage V2 to the spark plug 1.

When the secondary voltage V2 generated in the secondary coil 160 reaches a dielectric breakdown voltage of the gap 76 of the spark plug 1, the gap 76 may begin electric discharge, and the discharge current i2 begins to flow through the gap 76. Thus, secondary current i2 and the secondary voltage V2 show a sharp drop at the timing t2. In this way, the ignition device 1000 may cause a spark discharge at the spark plug 1 for a predetermined ignition period.

In the present example, as the secondary voltage V2 is applied to the piezo actuator 50, the piezo actuator 50 may shrink. Thus, the piezo actuator 50 may retract the center electrode 70 from the ground electrode 80 thereby to increase the gap 76.

Thereafter, electric charge caused in the piezo actuator 50 may be drained from the other internal terminal 56 through the internal conductor 54 and the one internal terminal 52 into the main terminal 10. As the piezo actuator 50 discharges the electric charge into the main terminal 10, the piezo actuator 50 may start to shrink to its original form. In this way, the piezo actuator 50 may extrude the center electrode 70 into the original position. That is, the piezo actuator 50 may move the center electrode 70 toward the ground electrode 80 thereby to decrease the gap 76.

At each of the timings t3 and t5, an operation similar to the operation between the timings t1 and t3 may be started again. In this way, the sparkplug 1 repeats the series of the operations to cause the spark simultaneously with the expansion and shrinkage of the gap 76.

The movement of the piezo actuator 50 and the center electrode 70 will be described with reference to FIGS. 4 to 6.

Figure 4:
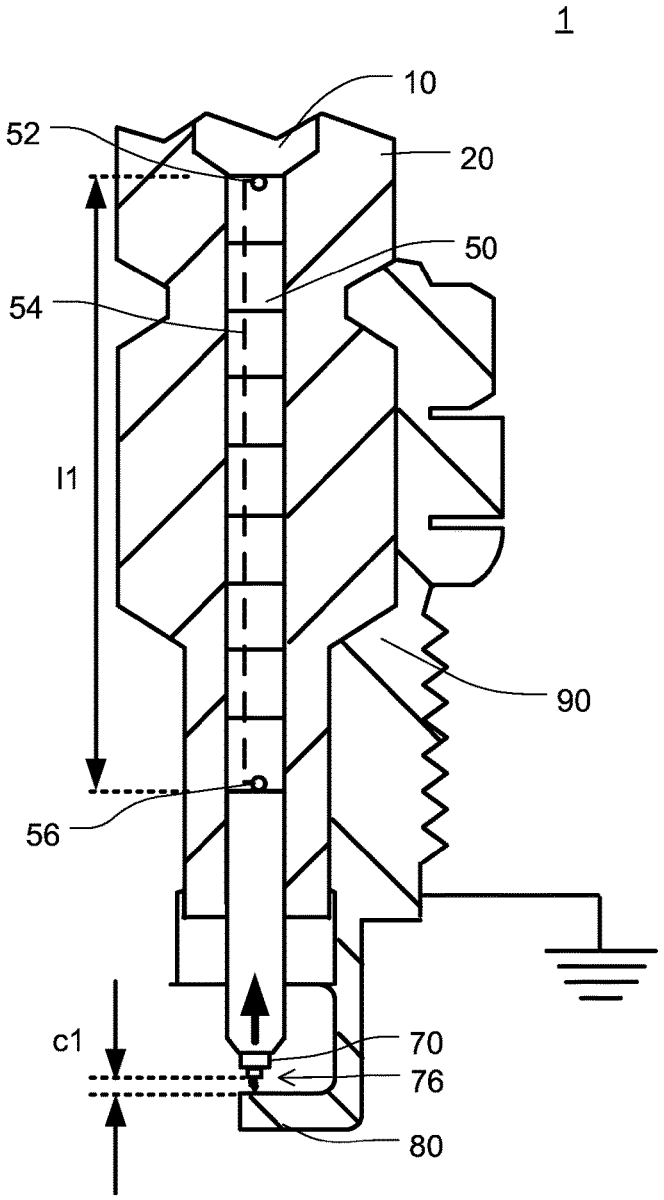
FIGS. 4 to 6 are schematic sectional views showing a sequential operation of the sparkplug.

In FIG. 4, on or immediately after the timing t2, the piezo actuator 50 is at an original length l1, and the gap 76 is at an original distance c1. The electrodes 70 and 80 generate a spark core in the gap 76 therebetween. In the present state, the piezo actuator 50 is applied with a part of the secondary voltage V2 thereby to start to expand itself. Thus, the piezo actuator 50 starts to retract the center electrode 70 in the direction shown by an arrow.

Figure 5:
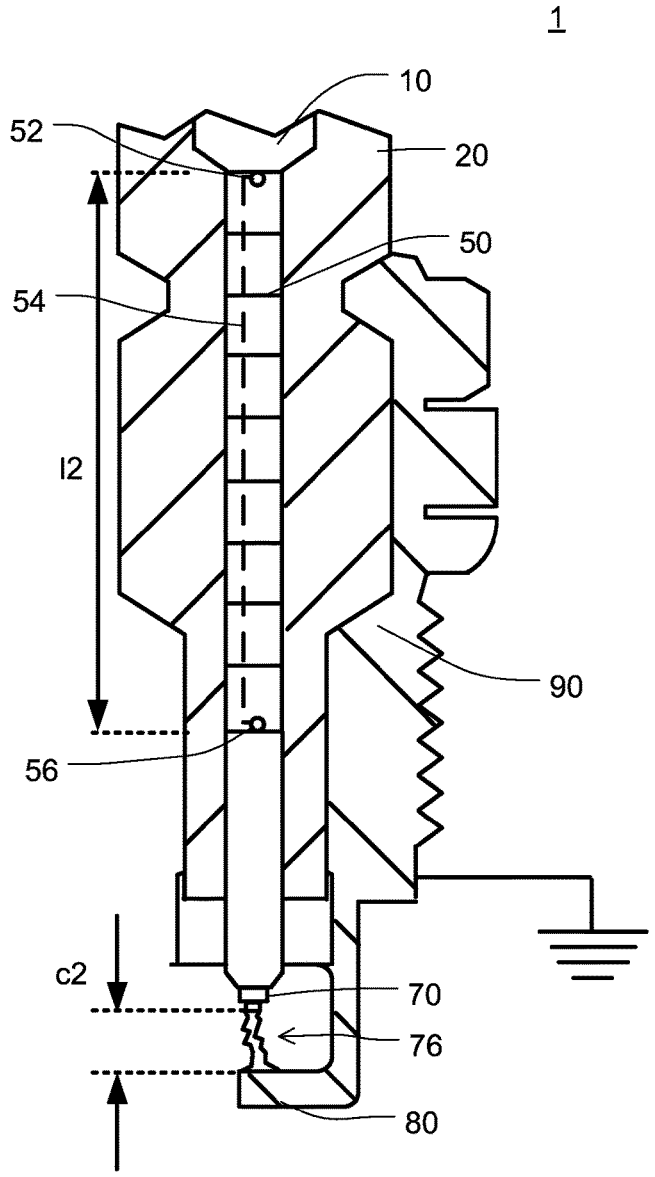
Figure 6:
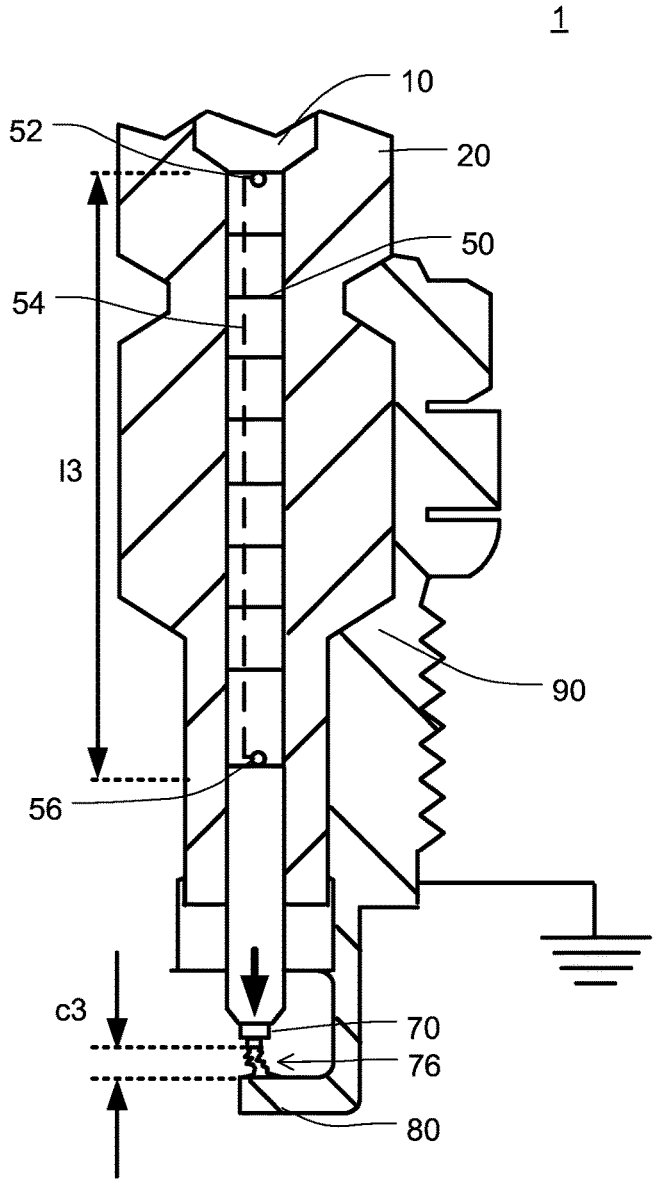

In FIG. 5, after elapse of a short time subsequent to the timing t2, the piezo actuator 50 may shrink to a length l2 to retract the center electrode 70 thereby to elongate the gap 76 at a distance c2. In the present operation, the piezo actuator 50 may retract the center electrode 70 while maintaining the spark in the gap 76. Therefore, the center electrode 70 may expand the spark core into an elongated spark at the length c2.

Subsequently, in FIG. 6, after elapsing a short time subsequent to the state in FIG. 5, the piezo actuator 50 may expand itself to a length l3. Thus, the piezo actuator 50 may return the center electrode 70 in the direction shown by an arrow toward the original position. In this way, the piezo actuator 50 may shorten the gap 76 at a distance c3. FIG. 6 shows the spark in the gap 76, nevertheless, the spark may disappear after causing combustion of mixture gas. Subsequently, the piezo actuator 50 may return to its original length l1 to return the gap 76 into the original distance c1 as in FIG. 1.

As described above, the sequential operation shown by FIGS. 3 to 5 are repeated to form the spark core in a small original gap 76 and to expand the spark core into the elongated spark. In the original state of FIG. 3, the small original gap 76 may facilitate to cause dielectric breakdown thereby to form of the spark gap 76. In addition, in the subsequent state of FIG. 5, the elongated gap 76 may form the elongated spark thereby to increase a contact are of the elongated spark with mixture gas in the combustion chamber.

Second Embodiment

Figure 7:
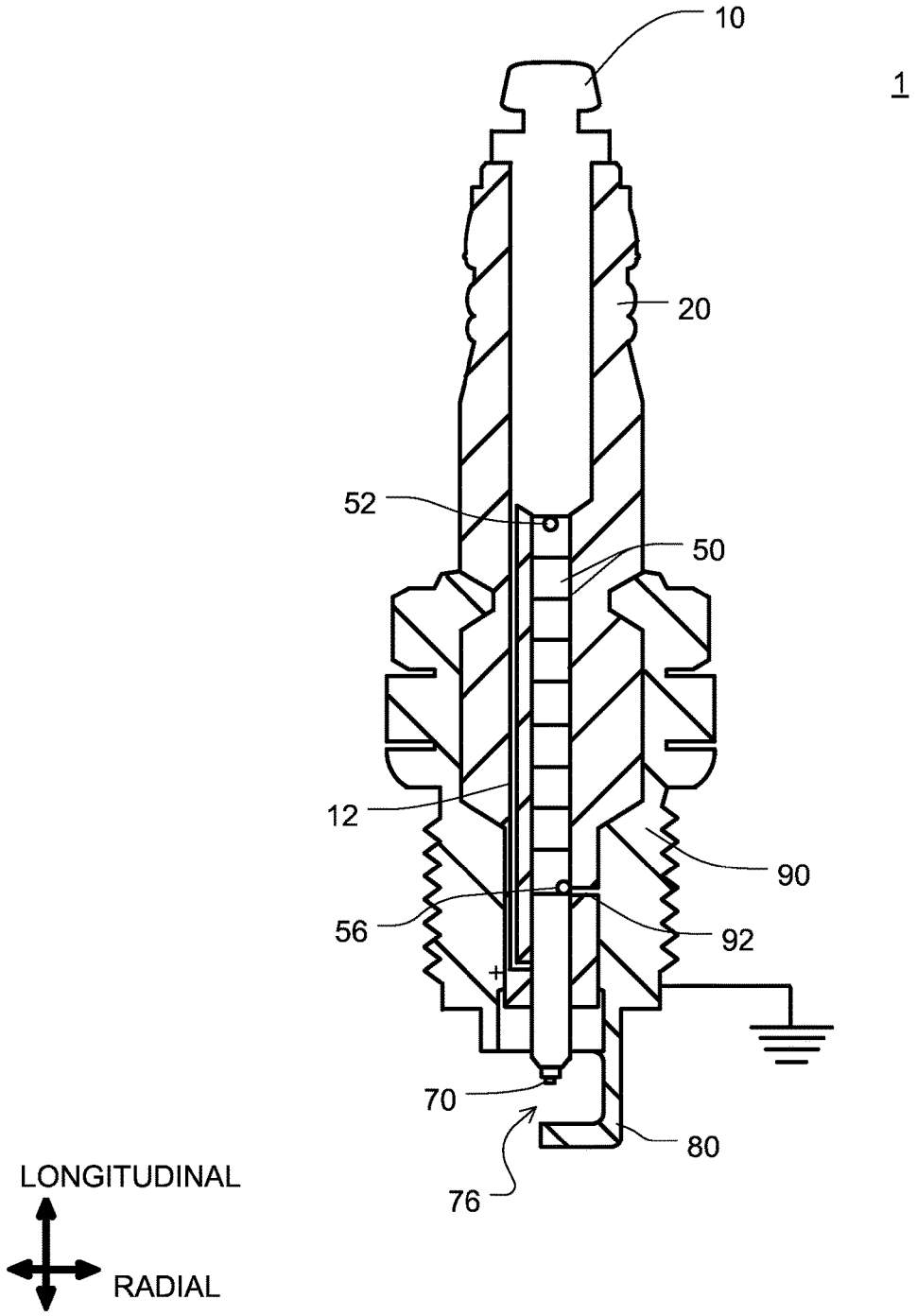
FIG. 7 is a schematic sectional view showing a sparkplug of a second embodiment.

As shown in FIG. 7, according to the present example, the internal conductor 54 of the first embodiment may be omitted. The sparkplug 1 may include a terminal conductor 12 electrically coupling the main terminal 10 with the center electrode 70. The terminal conductor 12 may be formed of a conductive material such as a copper material. The terminal conductor 12 may be slidable on a surface of the center electrode 70 thereby to maintain electric conductivity with the center electrode 70 even when the center electrode 70 axially moves. The piezo actuator 50 may be electrically coupled with the main terminal 10 at one end through the one internal terminal 52. The piezo actuator 50 may be further electrically coupled with the housing 90 at the other end through the other internal terminal 56 and a piezo conductor 92. The piezo conductor 92 may be formed of a conductive material such as a copper material. Therefore, the other internal terminal 56 may be grounded through the piezo conductor 92 and the housing 90. The piezo conductor 92 may be slidable on the other internal terminal 56 and may maintain electric conductivity with the other internal terminal 56 even when the piezo actuator 50 expands. In the present configuration, when voltage relative to the ground is applied to the main terminal 10, the voltage may be applied on the piezo actuator 50 through the internal terminals 52 and 56 and the piezo conductor 92. In addition, the voltage may be also applied on the center electrode 70 through the terminal conductor 12.

Figure 8:
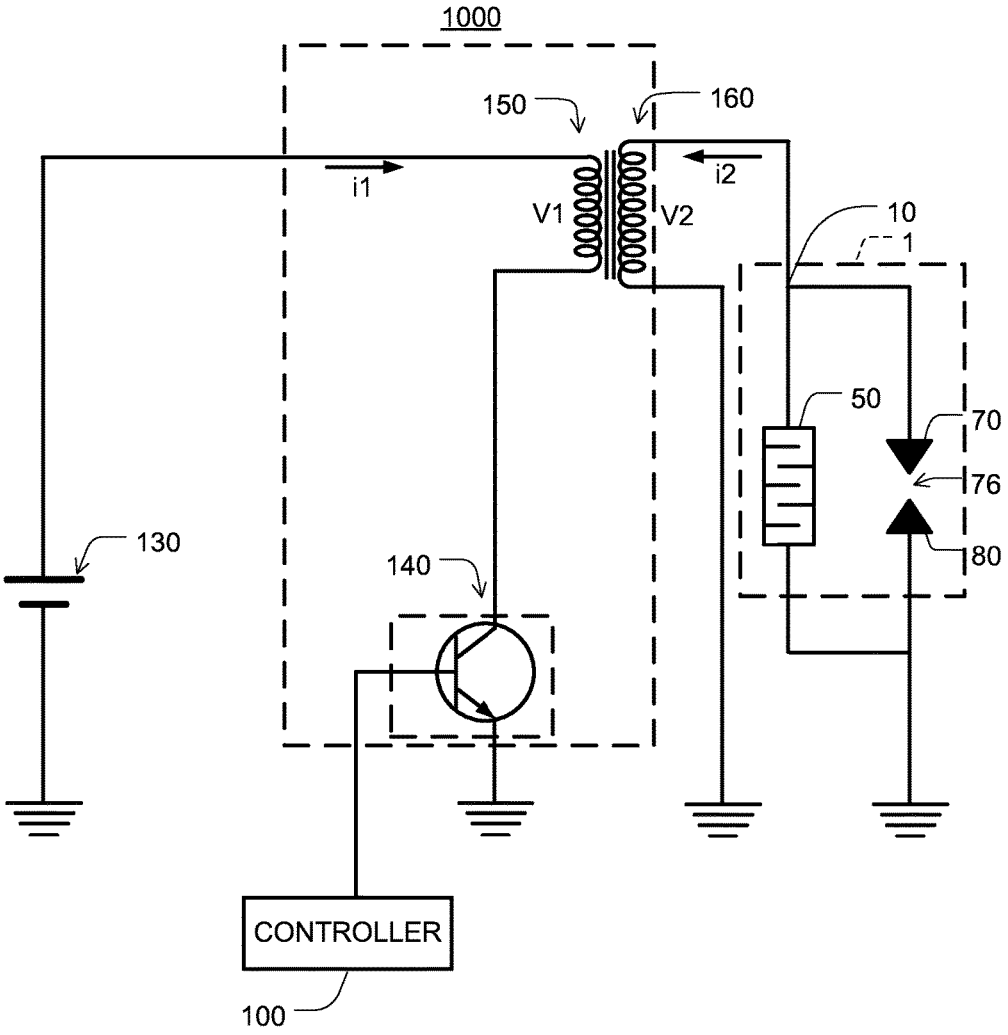
FIG. 8 is a schematic diagram showing an ignition device of the second embodiment.

In FIG. 8, in the present example, the piezo actuator 50 and the electrodes 70 and 80 may be connected in parallel with the secondary coil 160 and the ground. When the secondary coil 160 generates the secondary voltage V2, the secondary voltage V2 may be applied to both the piezo actuator 50 and the electrodes 70 and 80. On application of the secondary voltage V2, the electrodes 70 and 80 may generate the spark, and simultaneously, the piezo actuator 50 may start to shrink to retract the center electrode 70 thereby to increase the gap 76. After secondary current i2 returns to the secondary coil 160, application of the secondary voltage V2 may cease. Thus, the piezo actuator 50 may shrink to the original length and may return the center electrode 70 at the original position thereby to return the gap 76 into the original distance.

Third Embodiment

Figure 9:
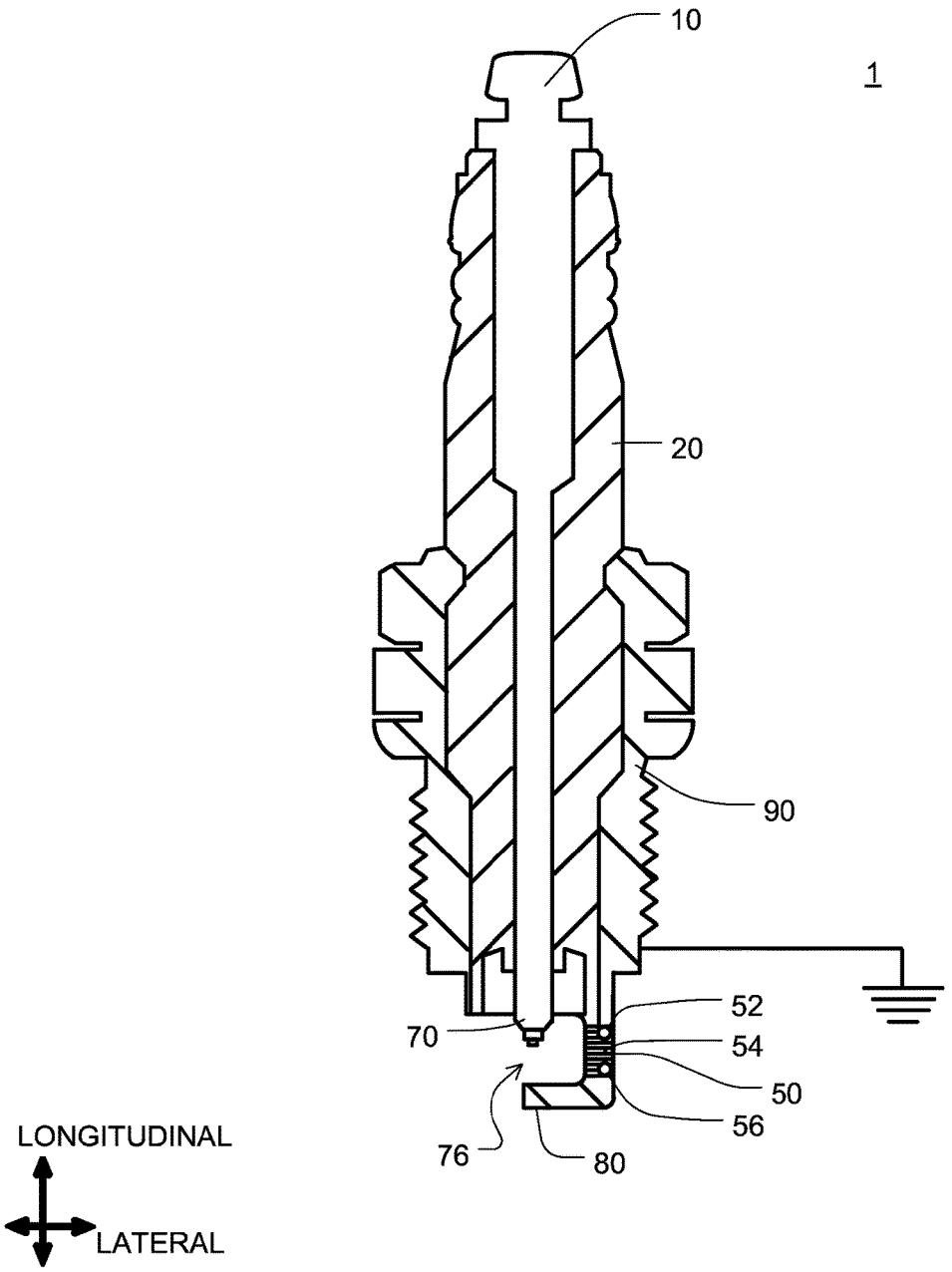
FIG. 9 is a schematic sectional view showing a sparkplug of a third embodiment.

As shown in FIG. 9, according to the present example, the piezo actuator 50 may be equipped at an intermediate portion of the ground electrode 80. In the present example, the piezo actuator 50 may be configured to expand in the longitudinal direction on application of voltage. The piezo actuator 50 may be further configured to shrink in the longitudinal direction to its original form on release of the voltage application.

In the example, the piezo actuator 50 may include internal terminals 52 and 56 and the internal conductor 54, similarly to the first embodiment. The piezo actuator 50 may be electrically coupled with the housing 90 at one internal terminal 52. That is, the piezo actuator 50 may be grounded through the one internal terminal 52 and the housing 90. The piezo actuator 50 may be electrically coupled with the ground electrode 80 through the other internal terminal 56. The internal conductor 54 may electrically couple the internal terminals 52 and 56 therebetween to enable conduction of electric current between the internal terminals 52 and 56. Thus, the internal conductor 54 may enable conduction of electric current between the housing 90 and the ground electrode 80. The internal conductor 54 may maintain electric conductivity between the housing 90 and the ground electrode 80 even when the piezo actuator 50 axially expands and even when the ground electrode 80 axially moves.

In the present configuration, when voltage relative to the ground is applied to the main terminal 10, and when the gap 76 causes electric breakdown to generate a spark, an electric circuit is formed from the ground, the housing 90, the internal terminal 52, the internal conductor 54, the internal terminal 56, the ground electrode, and the center electrode 70. Thus, the voltage may be applied on the piezo actuator 50.

In the present embodiment, the piezo actuator 50 may expand on application of voltage to move the ground electrode away from the center electrode 70. Therefore, the piezo actuator 50 may function to expand the gap 76 producing a spark core, similarly to the first embodiment. The present configuration may also enable to expand the gap thereby to expand the spark core formed in the gap.

The sparkplug 1 of the present example may be applied to the circuit of FIG. 2. That is, the sparkplug 1 may be connected with the piezo actuator 50 in series between the secondary coil 160 and the ground electrode 80. Operation of the sparkplug 1, excluding the property of the piezo actuator 50, may be similar to that of the first embodiment. In consideration of the property of the piezo actuator 50, an inverter may be added in series to the piezo actuator 50 to invert voltage application on the piezo actuator 50.

Fourth Embodiment

Figure 10:
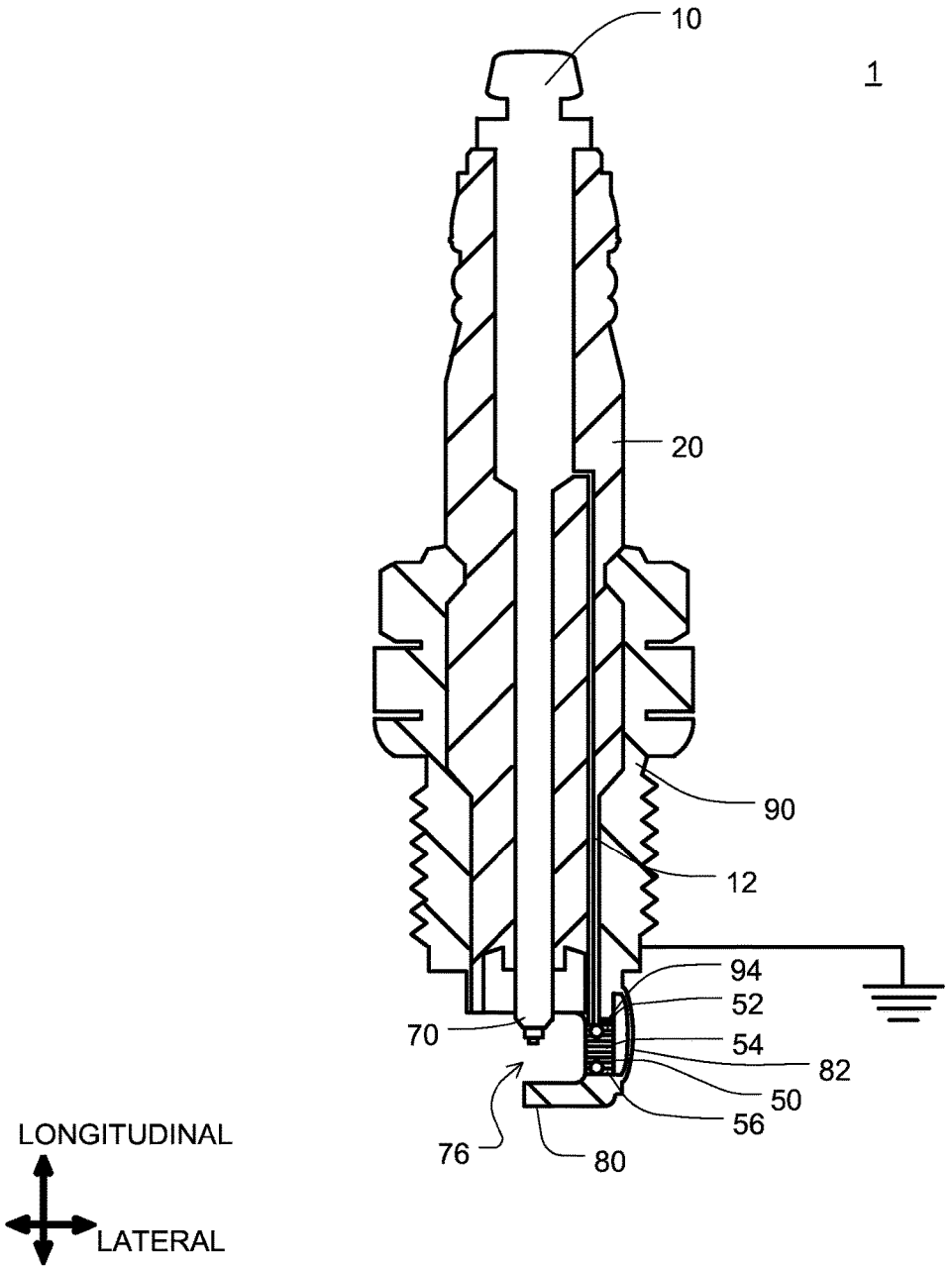
FIG. 10 is a schematic sectional view showing a sparkplug of a fourth embodiment.

As shown in FIG. 10, according to the present example, the piezo actuator 50 may be equipped at an intermediate portion of the ground electrode 80, similarly to the third embodiment. In the example, the sparkplug 1 may include the terminal conductor 12 electrically coupling the main terminal 10 with one internal terminal 52 of the piezo actuator 50. An insulative layer 94 may electrically insulate between the housing 90 and the piezo actuator 50. That is, the piezo actuator 50 is electrically insulated from the housing 90 on the upper side in the drawing. The other internal terminal 56 of the piezo actuator 50 may be electrically coupled with the ground electrode 80. The ground electrode 80 may be electrically coupled with the housing 90 through a ground conductor 82. That is, the ground electrode 80 may be grounded through the ground conductor 82 and housing 90. Thus, the ground conductor 82 may enable conduction of electric current between the housing 90 and the ground electrode 80. The ground conductor 82 may be resilient and may maintain electric conductivity between the ground electrode 80 and the housing 90 even when the ground electrode 80 moves relative to the housing 90. In the example, the piezo actuator 50 may not include the internal conductor 54 of the third embodiment.

In the present configuration, when voltage relative to the ground is applied to the main terminal 10, and when the gap 76 causes electric breakdown to generate a spark, an electric circuit is formed from the ground, the housing 90, the ground conductor 82, the ground electrode 80, and the center electrode 70. In addition, the voltage may be applied on the piezo actuator 50.

In the present embodiment, the piezo actuator 50 may expand on application of voltage to move the ground electrode away from the center electrode 70. Therefore, the piezo actuator 50 may function to expand the gap 76, which produces a spark core, similarly to the first embodiment.

The sparkplug 1 of the present example may be applied to the circuit of FIG. 8. That is, the electrodes 70 and 80 may be connected with the piezo actuator 50 in parallel between the secondary coil 160 and the ground. Operation of the sparkplug 1, excluding the property of the piezo actuator 50, may be similar to that of the second embodiment. In consideration of the property of the piezo actuator 50, an inverter may be added in series to the piezo actuator 50 to invert voltage application on the piezo actuator 50.

Fifth Embodiment

Figure 11:
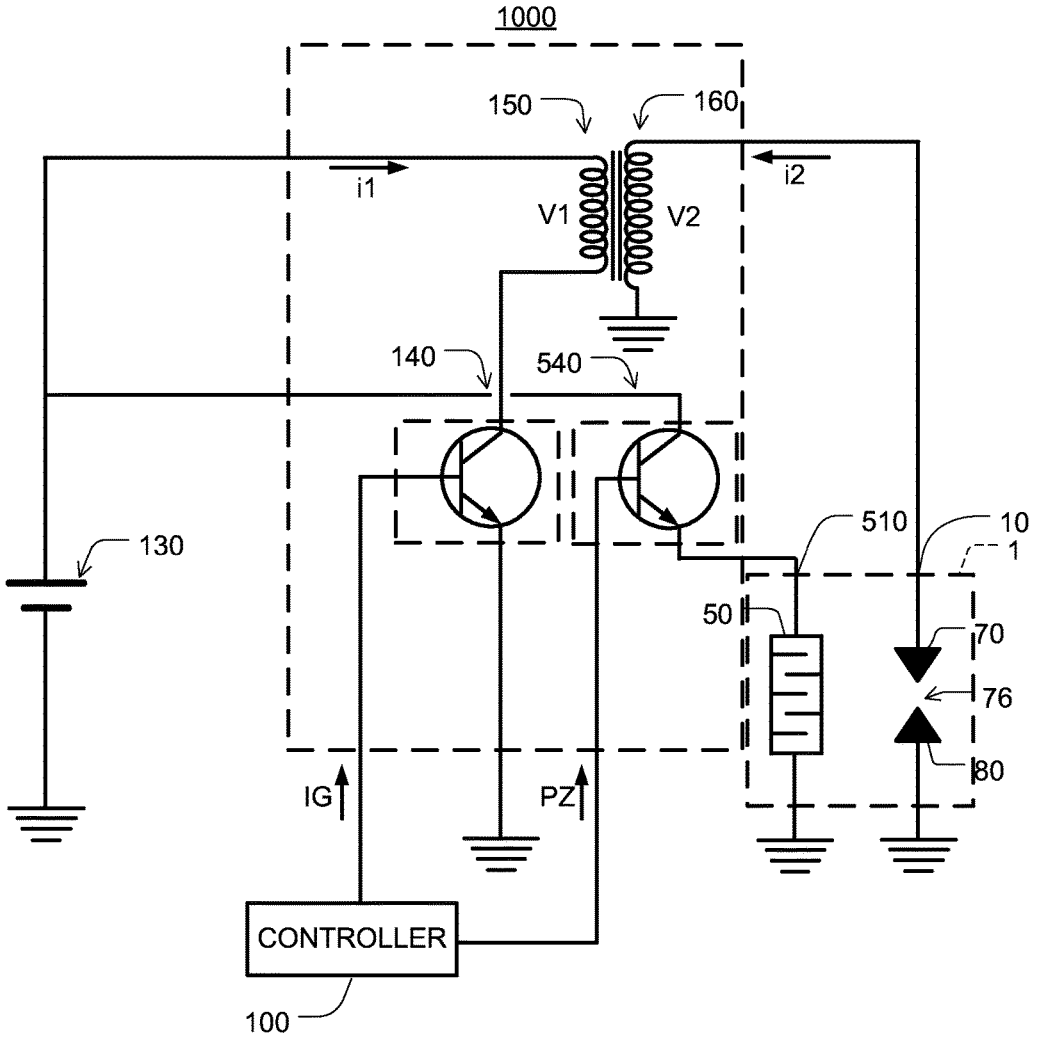
FIG. 11 is a schematic diagram showing an ignition device of a fifth embodiment.

As shown in FIG. 11, according to the present example, the ignition device 1000 may further include a piezo switch 540 in addition to the igniter switch 140. The additional piezo switch 540 may be an IGBT.

The piezo switch 540 may have an emitter connected with the piezo actuator 50 through a wiring. The piezo actuator 50 may be grounded through a wiring. The piezo switch 540 may have a base connected with the control unit 100 through a wiring to receive a piezo actuator signal PZ. The wiring connected with the base of the piezo switch 540 may be separate from the wire connected with the base of the igniter switch 140. The piezo switch 540 may have a collector connected with the power source 130 through a wiring, which is branched from the wiring connected with the primary coil 150.

In the example, the sparkplug 1 may have a piezo terminal 510 for the piezo actuator 50 in addition to the main terminal 10. The piezo terminal 510 may be connected with the emitter of the piezo switch 540 through the wiring. The piezo actuator 50 may be separately grounded from the sparkplug 1. Alternatively, the piezo actuator 50 may be commonly grounded with the sparkplug 1.

In the example, on receiving the piezo actuator signal PZ from the control unit 100 through the base, the piezo switch 540 may apply the primary voltage V1 of the power source 130 on the piezo actuator 50. When the control unit 100 terminates the piezo actuator signal PZ, the piezo switch 540 may terminate the application of the primary voltage V1 on the piezo actuator 50. In this way, the control unit 100 may control activation and deactivation of the piezo actuator 50 individually from the sparkplug 1. The present example may enable the control of the piezo actuator 50 independently from the control of the sparkplug 1. Therefore, the present configuration may enable to optimize timings of the operation of the piezo actuator 50 relative to operation (activation and deactivation) of the sparkplug 1 adaptive to, for example, operation condition of the engine.

Other Embodiment

The piezo actuator 50 may have a capacity enough to accumulate electric charge caused by spark. In this case, the internal conductor 54 may be omitted. A capacitor may be added to the piezo actuator 50 to accumulate the electric charge.

The piezo actuator 50 may cause the electric discharge spontaneously as time elapses. In such a case, the internal conductor 54 may be also omitted.

In the first and third embodiment, the internal conductor 54 may be connected with additional internal terminals. The additional internal terminals may be separately provided from the internal terminals 52 and 56 and may be used to conduct electric current caused by spark. The additional internal terminals may reduce interference, which is caused by the electric current of spark, on voltage application on the piezo actuator 50.

The piezo actuator 50 may be configured to expand on application of voltage. In this case, application of voltage may be inverted in the circuits exemplified in the above embodiments.

The above embodiments may be partially or entirely combined arbitrarily.

It should be appreciated that while the processes of the embodiments of the present disclosure have been described herein as including a specific sequence of steps, further alternative embodiments including various other sequences of these steps and/or additional steps not disclosed herein may be intended to be within the steps of the present disclosure.

While the present disclosure may have been described with reference to preferred embodiments thereof, it may be to be understood that the disclosure may be not limited to the preferred embodiments and constructions. The present disclosure may be intended to housing various modification and equivalent arrangements. In addition, while the various combinations and configurations, which may be preferred, other combinations and configurations, including more, less or only a single element, may be also within the spirit and scope of the present disclosure.

What is claimed is:

1. A sparkplug comprising:

a main terminal;

a center electrode electrically coupled with the main terminal;

a ground electrode opposed to the center electrode to form a gap therebetween; and a piezo actuator configured to change in length on application of a voltage, wherein the piezo actuator is configured to actuate one of the center electrode and the ground electrode to manipulate the gap.

2. The sparkplug of claim 1, wherein the piezo actuator is configured to increase the gap to expand an electric spark when the gap forms the electric spark on voltage application.

3. The sparkplug of claim 2, wherein the piezo actuator is configured to decrease the gap into an original form on release of the voltage application.

4. The sparkplug of claim 1, wherein the piezo actuator is electrically coupled with the main terminal and the ground electrode in series.

5. The sparkplug of claim 1, wherein the piezo actuator is electrically coupled with the main terminal and the ground electrode in parallel.

6. The sparkplug of claim 1, wherein the piezo actuator is affixed to the center electrode and is configured to actuate the center electrode.

7. The sparkplug of claim 6, further comprising:

a housing integrated with the ground electrode, wherein the housing surrounds the center electrode, and the center electrode is movable relative to the housing.

8. The sparkplug of claim 6, wherein the piezo actuator is located between the main terminal and the center electrode.

9. The sparkplug of claim 8, wherein the piezo actuator includes internal electrodes and an internal conductor, the internal electrodes are electrically coupled with the main terminal and the center electrode, respectively, and the internal conductor electrically couples the internal electrodes therebetween.

10. The sparkplug of claim 1, wherein the piezo actuator is affixed to the ground electrode and is configured to actuate the ground electrode.

11. The sparkplug of claim 10 further comprising:

a housing surrounding the center electrode, and the piezo actuator is located between the ground electrode and the housing.

12. The sparkplug of claim 11, wherein the piezo actuator includes internal electrodes and an internal conductor, the internal electrodes are electrically coupled with the ground electrode and the housing, respectively, and the internal conductor electrically couples the internal electrodes therebetween.

13. An ignition coil device comprising:

a primary coil;

a secondary coil magnetically coupled with the primary coil to boost primary voltage in the primary coil into a secondary voltage;

a sparkplug electrically connected with the secondary coil to receive application of the secondary voltage;

an igniter switch configured to cause a primary current in the primary coil to generate the primary voltage in the primary coil; and a piezo switch electrically connected with the sparkplug, wherein the sparkplug includes:

a center electrode and a ground electrode forming a gap therebetween; and a piezo actuator configured to actuate one of the center electrode and the ground electrode to manipulate the gap, wherein the piezo switch is configured to apply voltage on the piezo actuator independently from the igniter switch.

14. The ignition coil device of claim 13, wherein the sparkplug has a main electrode electrically coupled with the center electrode, and the sparkplug has a piezo terminal connected with the piezo switch.

* * * * *